US007891063B2

(12) United States Patent
Herb-Weinert et al.

(10) Patent No.: US 7,891,063 B2
(45) Date of Patent: Feb. 22, 2011

(54) FRINGE MAKER

(75) Inventors: Deborah Herb-Weinert, Big Sandy, TN (US); Karl H. Weinert, Big Sandy, TN (US)

(73) Assignee: Deborah Weinert

( * ) Notice: Subject to any disclaimer, the term of this patent is extended or adjusted under 35 U.S.C. 154(b) by 387 days.

(21) Appl. No.: 12/284,615

(22) Filed: Sep. 22, 2008

(65) Prior Publication Data

US 2010/0072233 A1 Mar. 25, 2010

(51) Int. Cl.
*D04D 5/00* (2006.01)

(52) U.S. Cl. ..... 28/145; 28/147; 223/46

(58) Field of Classification Search ..... 28/145, 28/147, 149, 150, 143; 223/44, 46, 120; 289/16.5, 17; 206/574, 575, 225, 226, 227
See application file for complete search history.

(56) References Cited

U.S. PATENT DOCUMENTS

| | | | | | |
|---|---|---|---|---|---|
| 2,335,053 | A * | 11/1943 | Gluck | 223/46 |
| 2,373,393 | A * | 4/1945 | Hall | 28/149 |
| 2,542,222 | A * | 2/1951 | Welch | 223/46 |
| 3,044,670 | A * | 7/1962 | Barefoot | 223/46 |
| 3,291,352 | A * | 12/1966 | Grikis | 223/46 |
| 3,591,904 | A * | 7/1971 | Rosene | 28/147 |
| 3,653,230 | A * | 4/1972 | Tosco | 66/85 R |
| D229,988 | S * | 1/1974 | Sovia | D3/26 |
| D231,871 | S * | 6/1974 | Webb | D3/26 |
| 3,816,888 | A * | 6/1974 | Rather, Jr. | 28/147 |
| 4,203,561 | A * | 5/1980 | Stillings | 242/486.9 |
| 4,454,968 | A * | 6/1984 | StLawrence | 223/46 |
| 4,616,769 | A * | 10/1986 | Steigler et al. | 223/46 |
| 5,297,705 | A * | 3/1994 | Schmidt | 223/46 |
| 5,356,056 | A * | 10/1994 | Teuten | 223/46 |
| 5,411,188 | A * | 5/1995 | Teuten | 223/46 |
| 5,829,650 | A * | 11/1998 | MacTaggart | 223/46 |
| 2008/0000934 | A1 * | 1/2008 | Schorr | 223/46 |

* cited by examiner

*Primary Examiner*—Amy B Vanatta

(57) ABSTRACT

A fringe maker for winding yarns to make a fringe. The fringe maker includes an elongated base having a pair of spaced crank and idler support member recesses interconnected by a longitudinal winding rod recess, a gripping slot, and a ruler recess. A pair of crank and idler support members are pivotally connected to the base within respective of the crank and idler support member recesses. Each has an upright operating position stopped against the base and a horizontal storage position disposed within the support member recesses that each define a storage area thereunder. A pair of crank and idler winding arms each have a central area rotatably connectable to respective of the support members while in the operating positions to rotate about a horizontal axis. A pair of elongated winding rods are disposable in a plurality of spaced relationships equidistant from and at opposite sides of the axis to interconnect the winding arms and form a removable winding unit. A hand crank is used for hand-driving the crank winding arm. A middle winding arm has a pair of end slots and two pluralities of side slots that closely receive the winding rods in the spaced relationships that snap-fits to the winding rods intermediate the winding arms. A bendable ruler closely fits within the ruler recess for storage.

24 Claims, 3 Drawing Sheets

FRINGE MAKER

BACKGROUND OF THE INVENTION

1. Field

Figure 1:
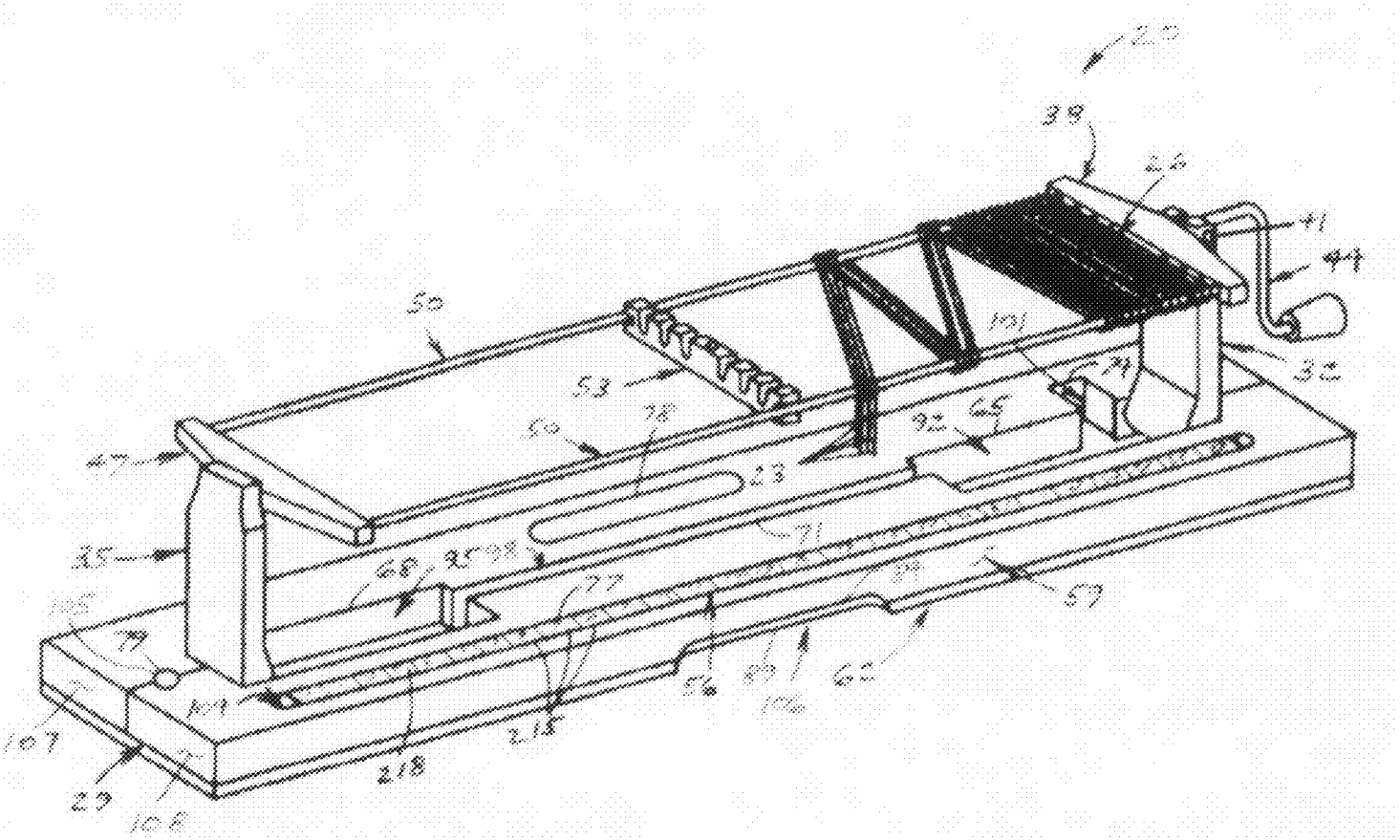

The present invention generally relates to devices used for making decorative yarn fringes used on draperies, pillows, clothing, and the like, and more particularly to such fringe making devices that are hand-powered for home use.

2. State of the Art

Decorative yarn fringe is used at the top of draperies, around the peripheral edge of pillows, on shirt pockets and other items of clothing, and the like to enhance their appeal and aesthetic qualities. Though hand-made fringes originated many years ago, most today are mass-produced using high-speed weaving or similar type equipment. Such hand-made fringes were made by hand-winding yarns around a template, such as two spaced-apart boards, hand-sewing a retaining seam along one board to secure the fringe, and snipping the "loops" at the opposite board to release the bottom thereof.

More recently, in accordance with the retro-trend to make clothing by hand, a hand-winding device, or fringe maker, has been marketed to facilitate hand-winding of fringes. The fringe maker is mostly made of wood with an elongated base of solid wood construction. Respective crank and idler support members removably connected to the base extending upwardly using respective dowels pins. A crank winding arm is rotatably secured to the crank support member using a retaining pin for hand-driving using a hand crank. An idler winding arm is rotatably connected to the idler support member. A pair of elongated winding rods interconnect the support members. A middle winding arm connects to and reinforces the winding rods intermediate the crank and idler winding arms. An elongated, U-shaped yarn guide rod is removably connected extending upwardly from the base.

The crank support member has a crank-receiving slot that closely rotatably receives the hand crank and a pin-receiving hole that intersects the crank-receiving slot to receive the retaining pin and retain the hand crank thereto. The idler support member has a rotation bore.

The crank and idler winding arms are each of truncated triangular shape. Two pluralities of rod-receiving holes extend through the winding arms that closely receive the winding rods in a plurality of the spaced relationships. A pivot bore is centrally disposed extending into the support section. A rotation pin extends from the pivot bore of the idler winding arm. The idler winding arm is rotatably connectable to the idler support member while in the operating position by inserting the rotation pin into the rotation bore thereof.

The hand crank includes a drive rod that comprises a crank leg connected to a parallel, oppositely disposed handle leg through a connecting leg. The crank leg is coaxially affixed within the pivot bore of the crank winding arm to facilitate driving thereof using the hand crank. The crank leg of the drive rod is closely rotatably received within the crank-receiving slot of the crank support member and secured therein by inserting the retaining pin into the pin-receiving hole.

The winding rods each include opposite ends that closely fit within the rod-receiving bores of the winding arms. The winding rods are disposable in a plurality of spaced relationships equidistant from and at opposite sides of a horizontal axis to interconnect the winding arms and form a removable winding unit.

The middle winding arm is of elongated generally rectangular shape that includes a pair of rod-receiving end holes, and two pluralities of rod-receiving side slots that closely receive the winding rods in the plurality of the spaced relationships. The holes and slots correspond to the rod-receiving bores of the crank and idler winding arms.

The fringe maker is used by placing it onto the support surface. During a winding process, a plurality of yarns are tied to one of the winding rods and the hand crank is rotated to pass the yarns under the yarn guide rod and wind around the winding rods. Once the yarns are wound onto the winding rods they are tied-off to secure. The retaining pin is removed from the crank support member. The crank and idler winding arms, the hand crank, and the winding rods with wound yarns are removed from the base with support members as a single unit for transport to a sewing machine to sew a longitudinal retaining seam closely adjacent one of the winding rods to complete the fringe. The winding rods are then removed from the crank and idler winding arms and the fringe is removed therefrom. The crank and idler winding arms, the hand crank, and the winding rods minus the fringe are then reassembled to the base with support members and a new winding process is started.

While the prior art fringe maker works reasonably well, it has numerous serious shortcomings. First, even though the base is made of solid wood, it is rather small and thin so as to be lightweight. This makes the fringe maker rather unstable during winding and prone to tipping. Second, the winding rods block the view of the yarn guide rod in certain rotational positions during winding. Third, the fringe maker is not of heavy duty construction and prone to breakage. Fourth, the support members and the yarn guide rod are removable and thus can be lost. Fifth, the maximum width of the fringe that can be produced is only eleven inches. Sixth, there is no place to store the component parts including the support members, the winding arms, the retaining pin, the hand crank, the winding rods, and the yarn guide rod. Seventh, there is no ruler or measuring device for measuring items to receive the fringe and lengths of the fringe during winding. There is a need for a fringe maker that solves these problems.

SUMMARY OF THE INVENTION

The present invention is a fringe maker for winding yarns to make a fringe. The fringe maker includes an elongated base having a pair of spaced crank and idler support member recesses interconnected by a longitudinal winding rod recess. A pair of crank and idler support members are pivotally connected to the base within respective of the crank and idler support member recesses. Each has an upright operating position stopped against the base and a horizontal storage position disposed within the support member recesses that each define a storage area thereunder. A pair of crank and idler winding arms each have a central area rotatably connectable to respective of the support members while in the operating positions to rotate about a horizontal axis. A pair of elongated winding rods are disposable in at least one spaced relationship equidistant from and at opposite sides of the axis to interconnect the winding arms and form a removable winding unit. A hand crank is adapted for coaxially hand-driving the crank winding arm. The fringe is made by: 1) rotating the hand crank to wind the yarns around the winding rods; 2) removing the winding unit with wound yarns from the base with support members for sewing a retaining seam to complete the fringe; and 3) removing the fringe by disassembling the winding rods from the winding arms, the winding arms, the winding rods, and the hand crank being storable within the storage areas.

In a preferred fringe maker, the base has a ruler recess and is of a construction of a single piece or respective upper and lower bases that are affixed together. A bendable ruler is provided that when in a straight configuration closely fits within the ruler recess for storage. The support members each comprise an upper section of generally rectangular shape and a thicker lower section that is longitudinally tapered with a rounded bottom pivotally connected to the base using a plurality of pivot pins. The crank support member has a crank-receiving slot and a retaining device receiving hole that intersects the slot. The idler support member has a pivot bore. The winding rods are each of a cross-section of circular, rectangular, polygonal, or oblong. The winding arms each include a support section of truncated triangular shape. The support sections have the central area with a pivot bore. A rod section of rectangular shape is dependent from the support section having two pluralities of rod-receiving bores that closely receive opposite ends of the winding rods that are disposable in a plurality of the spaced relationships. The central area of the idler winding arm is rotatably connectable to the idler support member using a rotation pin that extends into the pivot bores thereof. The hand crank includes a drive rod having a crank leg with splined distal end coaxially affixed within the pivot bore of the crank winding arm and a parallel, oppositely disposed handle leg interconnected through a connecting leg. A gripping handle is connected to the handle leg. The crank leg is closely rotatably receivable within the crank-receiving slot of the crank support member being retained thereto by a retaining device received in the retaining device receiving hole. A middle winding arm is provide having a pair of end slots, two pluralities of side slots that closely receive the winding rods in the spaced relationships, and a clearance bore centrally disposed thereon to receive the rotation pin of the idler winding arm during storage. The end slots are at such a spacing and the side slots are angled inwardly so as to snap-fit to and reinforce the winding rods intermediate the winding arms.

In a further preferred fringe maker, the base has one or more features of a gripping slot, a gripping recess, a hanging hole, and a handle recess connected to one of the support member recesses. The upper base comprises a pair of edge-joined halves having a plurality of slots which the lower base covers to form the recesses. The pivot pins are each spring-biased from a retracted position disposed within one pivot bore to an extended position also disposed within an adjacent pivot bore to facilitate initial assembly. The retaining device is chosen from the group consisting of a spring plunger and a retaining pin received within the retaining device receiving hole of the crank support member. The base, the support members, the winding arms, the winding rods, and the hand crank are made of materials such as wooden boards, plywood, wood and plastic veneer, particle board, molded plastic, sheet plastic, stainless steel rod, and plated carbon steel rod.

THE DRAWINGS

Figure 2:
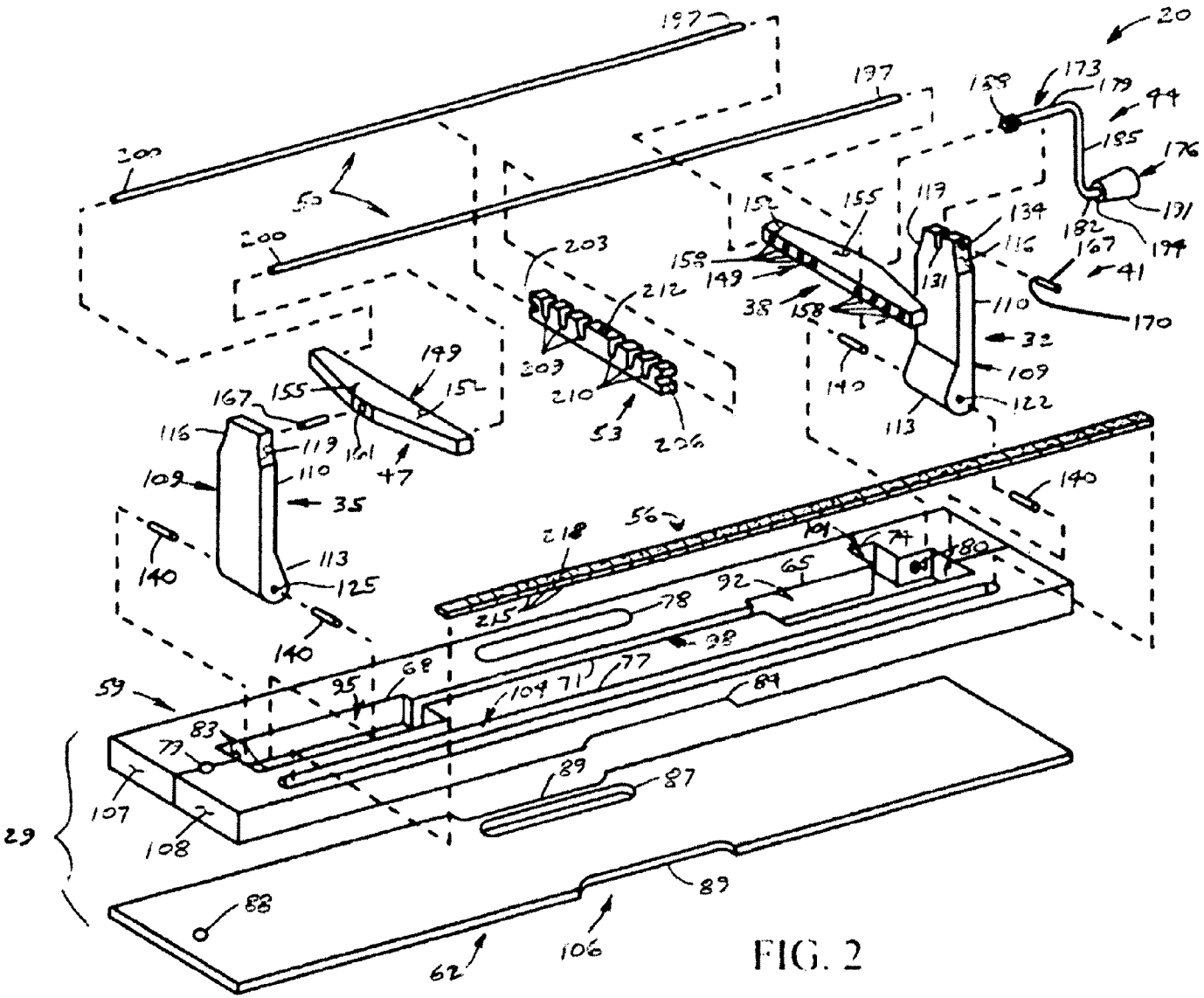
Figure 3:
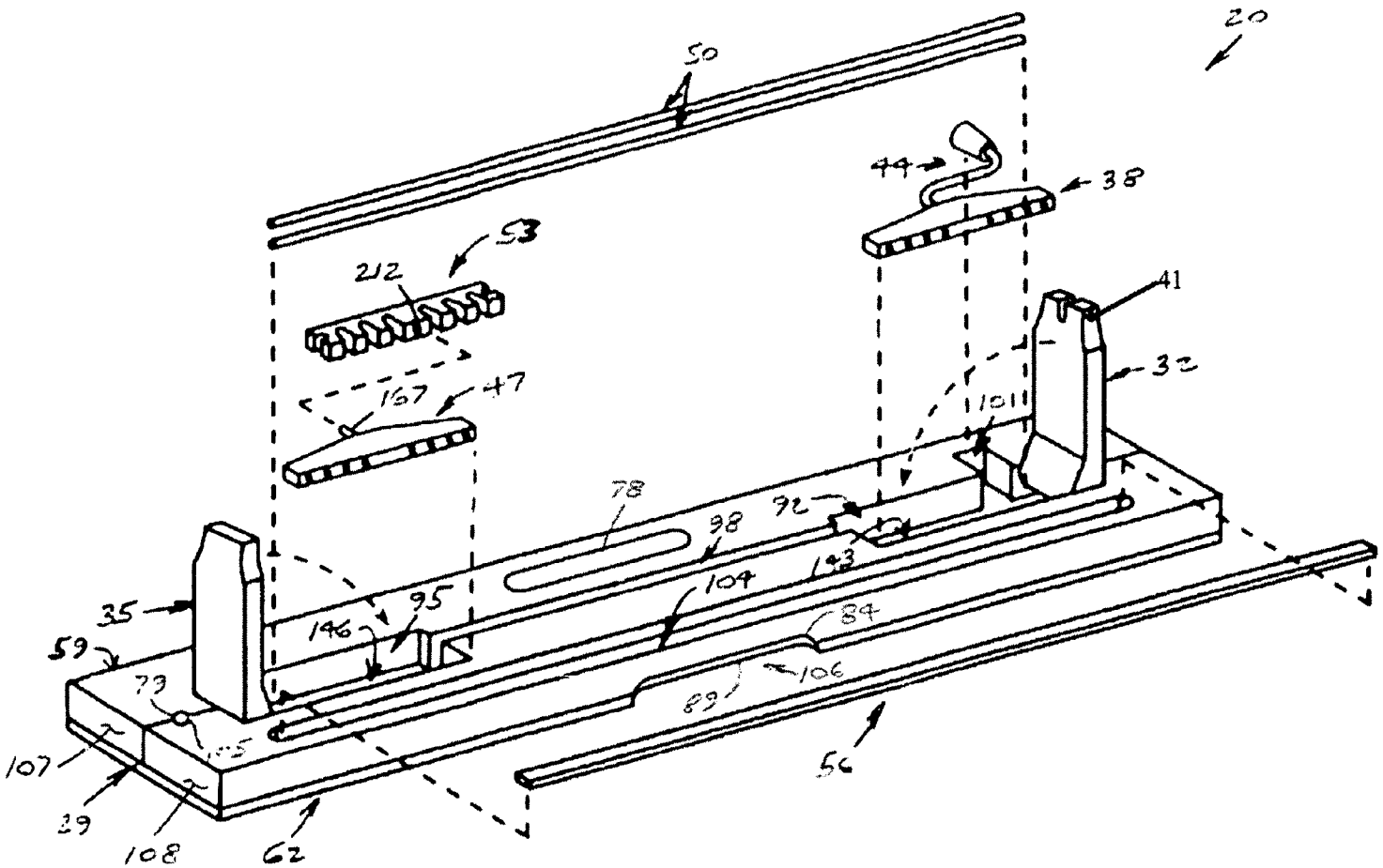

The best mode presently contemplated for carrying out the invention is illustrated in the accompanying drawings, in which:

FIG. 1 is a perspective view of a fringe maker of the present invention shown on a support surface in an unfolded operating position winding yarn to make a fringe;

FIG. 2, an exploded perspective view of the fringe maker, to a slightly reduced scale, showing a base to which crank and idler support members are pivotally connected, a crank winding arm rotatably secured to the crank support member using a hand crank and a spring plunger disposed within the crank support member, an idler winding arm rotatably connected to the idler support member, a pair of winding rods that interconnect the support members, a middle winding arm that snap-fits to the winding rods, and a bendable ruler; and FIG. 3, a perspective view of a fringe maker, to the slightly reduced scale, shown on the support surface with the crank winding arm, the hand crank, the idler winding arm, the winding rods, the middle winding arm, and the ruler detached for storage within the base in a storage position of the fringe maker.

DETAILED DESCRIPTION OF THE ILLUSTRATED EMBODIMENTS

Referring to FIG. 1, therein is shown a fringe maker of the present invention, designated generally at 20, supported on a support surface 21 for winding a plurality of yarns 23 to make a fringe 26.

The fringe maker 20 includes an elongated base 29 with a respective crank and idler support members 32 and 35 pivotally connected thereto. A crank winding arm 38 is rotatably secured to the crank support member 32 using a retaining device in the form of a conventional ball-nose spring plunger 41 for hand-driving using a hand crank 44. An idler winding arm 47 is rotatably connected to the idler support member 35. A pair of elongated winding rods 50 interconnect the support members 32 and 35. A middle winding arm 53 connects to and reinforces the winding rods 50 intermediate the crank and idler winding arms 38 and 47, and a conventional bendable ruler 56.

The base 29 includes an upper base 59 and a lower base 62. The upper base 59 has a pair of spaced crank and idler support member slots 65 and 68 each of generally rectangular shape interconnected by a longitudinal rod slot 71, a handle slot 74 connected to the end slot 65, an elongated ruler slot 77, an elongated gripping slot 78, and a hanging hole 79. A plurality of pairs of coaxial pivot bores 80 and 83 extend into the upper base 59 respectively disposed at the support member slots 65 and 68. A pair of gripping recesses 84 extend oppositely into the base 29. The lower base 62 has an elongated gripping slot 87, a hanging hole 88, and a pair of gripping recesses 89 that extend oppositely thereinto. The gripping slots 78 and 87, and the gripping recesses 84 and 89 help in gripping the base 29 in-hand for lifting.

The upper base 59 is affixed to the lower base 62 using adhesives, pegs, screws, or other suitable devices (none shown) covering the slots 65, 68, 71, 74, and 77 to form respective crank and idler support member recesses 92 and 95, an elongated winding rod recess 98, and a handle recess 101 that are all interconnected, an elongated handle slot 102, an elongated ruler recess 104, a hanging hole 105, and a pair of gripping recesses 106. Alternatively, the upper and lower bases 59 and 62 may be integral with the recesses 92, 95, 98, 101, 104 and 106, the handle slot 102, and the hanging hole 105 router-cut or molded thereinto.

The upper base 59 is preferably made in a single piece (e.g. a single wooden board) or from a pair of edge-joined halves 107 and 108 (e.g. a pair of wooden boards), though other suitable materials may be used such as wood or plastic veneer covered particle board, molded plastic, sheet plastic, and the like. The lower base 62 is preferably made from plywood, though other suitable materials such as those mentioned above may be used. Wood components may be left natural, stained, or otherwise finished as desired.

The crank and idler support members 32 and 35 are each made from a support blank 109 comprised of an upper section 110 of generally rectangular shape and a thicker, longitudinally tapered lower section 113 with a rounded bottom 114. The upper section 110 is laterally inwardly tapered having a pair of oppositely disposed, concave surfaces 116 and 119. The lower section 113 is rounded with a pair of pivot bores 122 and 125 that coaxially extend thereinto. The support blanks 107 are made of the materials described above. Note that the crank support 32 with spring plunger 41 can replace the idler support 35 if so desired for economy of parts.

The crank support member 32 has a crank-receiving slot 131 that closely rotatably receives the hand crank 44 and a retaining device receiving hole 134 that intersects the crank-receiving slot 131 to receive the spring plunger 41 and retain the hand crank 44 thereto. The idler support member 35 has a rotation bore 137. The lower sections 113 of the support members 32 and 35 are pivotally connected to the base 29 within respective of the support member recesses 92 and 95 of the base 29. This is done using a plurality of pivot pins 140 disposed within respective of the pivot bores 122 and 125 of the support members 32 and 35 and the pivot bores 80 and 83 of the upper base 59.

If the upper base 59 is made of the single piece, the pivot pins 140 are preferably each spring-biased to facilitate initial assembly. The pivot pins 140 can be outwardly spring-biased from an initial retracted position disposed within the pivot bore 80 of base 29 to an extended position also disposed within the adjacent pivot bore 122 of the crank support member 32. Alternatively, coaxial pairs of the pivot pins 140 they can be outwardly spring-biased by interconnecting the pivot bores 122 of the crank support member 32 and using a compression spring between the pivot pins 140. If the upper base 59 is made of the halves 107 and 108, then the pivot pins 140 can be of solid or tubular design. Further alternatively, the pivot pins 140 may be replaced by a single elongated pin (not shown) that is press-fit into the pivot bores 80 and 83 that are extended to pass completely through the upper base 59.

The support members 32 and 35 have respective upright operating positions disposed perpendicularly stopped against the base 29 and horizontal storage positions disposed parallel to the base 29 within respective of the support member recesses 92 and 95. The support members 32 and 35 are flush with the base 29 in the storage position forming respective storage areas 143 and 146 thereunder.

The crank and idler winding arms 38 and 47 are each made from an arm blank 149 comprised of a rod section 152 of rectangular shape and a dependent support section 155 of truncated triangular shape. Two pluralities of rod-receiving bores 158 extend into the rod section 152 that closely receive the winding rods 50 in a plurality of the spaced relationships. A pivot bore 161 is centrally disposed extending into the support section 155. A rotation pin 162 is affixed such as by press-fitting extending from the pivot bore 161 of the idler winding arm 47. The idler winding arm 47 is rotatably connectable to the idler support member 35 while in the operating position by inserting the rotation pin 167 into the rotation bore 137 thereof. The arm blanks 149 are made of the materials described above.

The spring plunger 41 includes an externally threaded housing 167 that is threadably received within the retaining device receiving 134 of the crank support member 32. An outwardly spring-biased ball 170 depends from the housing 167 that engages the hand crank 44 that snap-fits past the ball 170 when the crank support member 32 is pressed into the crank-receiving slot 131 thereof. The spring plungers 41 can be similarly used to retain the support members 32 and 35 in the storage positions during storage of the fringe maker 20. Alternatively, another retaining device such a retaining pin (not shown) may be used.

The hand crank 44 includes a drive rod 173 and an optional gripping handle 176 to facilitate gripping of the drive rod 173. The drive rod 173 comprises a crank leg 179 connected to a parallel, oppositely disposed handle leg 182 through a connecting leg 185. The crank leg 179 has a drive spline 188 that is coaxially affixed within the pivot bore 161 of the crank winding arm 38 such as by press-fitting to facilitate driving thereof using the hand crank 44. The drive rod 173 is preferably formed from stainless steel or plated carbon steel rod, though other suitable materials such as those mentioned above may be used.

The gripping handle 176 includes a handle member 191 in which a sleeve 194 is rotatably secured. The sleeve 194 is affixed to the handle leg 182 of the drive rod 173 such as adhesively or by crimping. The crank leg 179 of the drive rod 173 is closely rotatably received within the crank-receiving slot 131 of the crank support member 32 and secured therein by inserting the locking leg 167 of the spring plunger 41 into the retaining device receiving hole 134. The drive rod 173 is formed from the same material as the drive rod 173. The handle member 191 is turned from wood, molded from a suitable plastic material, or otherwise suitably made. The sleeve 194 is cut from steel or plastic tubing or otherwise suitably made.

The winding rods 50 each include opposite ends 197 and 200 that closely fit within the rod-receiving bores 158 of the winding arms 38 and 47. The winding rods 50 are disposable in a plurality of spaced relationships equidistant from and at opposite sides of a horizontal axis "A" to interconnect the winding arms 38 and 47 and form a removable winding unit 201. Each winding rod 50 and mating rod-receiving bore 158 is preferably of circular cross-section, though other cross-sections are possible such as rectangular, polygonal, or oblong. The winding rods 50 are preferably made from three-sixteenths diameter stainless steel rod or plated carbon steel rod.

The middle winding arm 53 is of elongated generally rectangular shape that includes a pair of rod-receiving end slots 203 and 206, and two pluralities of rod-receiving side slots 209 and 210 that closely receive the winding rods 50 in the plurality of the spaced relationships. The slots 203, 206, 209, and 210 correspond to the rod-receiving bores 158 of the crank and idler winding arms 38 and 47. The side slots 209 and 210 are angled inwardly so as to snap-fit to the winding rods 50 between the crank and idler winding arms 38 and 47. A clearance bore 212 is centrally disposed on the middle winding arm 53. The middle winding arm 53 is made of the materials described above.

The bendable ruler 56 is made up of a plurality of individual sections 215 that are pivotally interconnected. A measuring scale 218 is printed across the sections 215 in inches/feet or millimeters/centimeters. The ruler 56 closely fits within the ruler recess when in a straight configuration. The ruler 56 is provided for measuring items to receive the fringe 26 such as pillows, collars, cuffs, necklines, and pet collars to determine the length of fringe 26 to make. Disposed in the base 29, ruler 56 serves as visual aid so a user knows the length of fringe 26 required to be made.

The fringe maker 20 is used by placing it onto the support surface 21 while in the storage position, as depicted in FIG. 3. The crank winding arm 38 with attached hand crank 44 are disposed within the support member and handle recesses 65, 68, and 101. The idler support member 35 and the middle winding arm 53 with the rotation pin 162 disposed within the clearance bore 212 are disposed within the support member recess 95. The winding rods 50 are disposed within the support member recesses 92 and 95 and the winding rod recess 98. The ruler 56 is disposed within the ruler recess 104. The crank and idler support members 32 and 35 are in the storage positions disposed parallel to the base 29 within respective of the support member recesses 92 and 95. The crank winding arm 38 with hand crank 44 are disposed within the storage area 143 formed by the base 29 and the crank support member 32. The idler support member 35 and the middle winding arm 53 are disposed within the storage area 146 formed by the base 29 and the idler support member 35. The crank and idler support members 32 and 35 are retained in the storage positions and the ruler is retained within the ruler recess 104 using friction fits with the base 29. Alternatively, retaining devices (not shown) such as rubber bands, flexible straps, latches, or the like may be used.

The fringe maker 20 is moved from the storage position to an operating position by unlocking any retaining device that might be present and pivoting the crank and idler support members 32 and 35 upwardly to their operating positions. The crank winding arm 38 with attached hand crank 44, the idler support member 35, the middle winding arm 53, and the winding rods 50 are removed from the base 29 and assembled together as shown in FIGS. 1 and 2. The winding rods 50 are placed in the corresponding of the bores 158 of the crank and idler winding arms 38 and 47, and the end slots 203 and 206 or the side slots 209 and 210 of the middle winding arm 53 to make the fringe 26 of a desired size. The middle winding arm 53 stabilizes and maintains a desired spacing of the winding rods 50 during winding of the yarns 23. The ruler 56 may be removed from the ruler recess 104 to make measurements as required.

During a winding process, typically four yarns 23 are tied to one of the winding rods 50 and the hand crank 44 is rotated to wind the yarns 23 around the winding rods 50. The yarns 23 are initially wound onto the winding rods 50 close to the middle winding arm 53 then slid laterally towards the crank winding arm 38 as shown in FIG. 1. As more of the yarns 23 are wound onto the winding rods 50, the middle winding arm 53 is slid laterally towards the idler support member 35 to make room for them. Once the yarns 23 are wound onto the winding rods 50 they are tied-off to secure. The crank and idler winding arms 38 and 47, the hand crank 44, and the winding rods 50 with wound yarns 23 are removed from the base 29 with support members 32 and 35 as a single unit for transport to a sewing machine (not shown) to sew a longitudinal retaining seam (not shown) closely adjacent one of the winding rods 50 to complete the fringe 26. The winding rods 50 are then removed from the crank and idler winding arms 38 and 47 and the fringe 26 removed therefrom. The crank and idler winding arms 38 and 47, the hand crank 44, and the winding rods 50 minus the fringe 26 are then reassembled to the base 29 with support members 32 and 35 and a new winding process is started.

The fringe maker 20 is moved from the operating position to the storage position by reversing the above process. The storage position makes transport of the fringe maker 20 easy with a user using the gripping recesses 106 to lift the base 29 off the support surface 21 and using the handle slot 102 to carry the fringe maker 20.

Therefore, the fringe maker of the present invention solve the aforementioned shortcomings of the prior art devices by: 1) having a large, thick base that has the weight and footprint to be very stable; 2) eliminating the yarn guide rod which is unnecessary and prone to being in the way; 3) having a robust design that is very durable with support members that are thick and substantial to resist tension of the yarns during winding; 4) having support members that are permanently pivotally connected to the base and thus cannot be lost; 5) having a maximum width of the fringe that can be produced of twenty-four inches; 6) having integral storage for all of the component parts within the base to prevent loss, and to provide tidy, compact storage retained in place by the support members; and 7) providing a ruler that can be removed from the base to measure items to receive the fringe and replaced in the base to measure the fringe during winding.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. A fringe maker for winding yarns to make a fringe, comprising:

an elongated base having a pair of spaced crank and idler support member recesses interconnected by a longitudinal winding rod recess;

a pair of crank and idler support members pivotally connected to said base within respective of said crank and idler support member recesses each having an upright operating position stopped against said base and a horizontal storage position disposed within said support member recesses that each define a storage area thereunder;

a pair of crank and idler winding arms each having a central area rotatably connectable to respective of said support members while in said operating positions to rotate about a horizontal axis;

a pair of elongated winding rods disposable in at least one spaced relationship equidistant from and at opposite sides of said axis to interconnect said winding arms and form a removable winding unit;

a hand crank adapted for coaxially hand-driving said crank winding arm; and wherein the fringe is made by rotating said hand crank to wind the yarns around said winding rods, removing said winding unit with wound yarns from said base with support members for sewing a retaining seam to complete the fringe, and removing the fringe by disassembling said winding rods from said winding arms, said winding arms, said winding rods, and said hand crank being storable within said storage areas.

2. The fringe maker of claim 1, wherein the base has at least one feature chosen from the group consisting of a gripping slot, a gripping recess, a hanging hole, and a handle recess connected to the crank member recess.

3. The fringe maker of claim 1, wherein the base is of a construction chosen from the group consisting of a single piece and respective upper and lower bases that are affixed together.

4. The fringe maker of claim 3, wherein the upper base has a plurality of slots which the lower base covers to form the recesses.

5. The fringe maker of claim 4, wherein the upper base comprises a pair of edge-joined halves.

6. The fringe maker of claim 1, wherein the support members each comprise an upper section and a lower section pivotally connected to the base using a plurality of pivot pins.

7. The fringe maker of claim 6, wherein the upper sections are of generally rectangular shape and the lower sections are thicker and longitudinally tapered with a rounded bottom.

8. The fringe maker of claim 6, wherein the upper sections are laterally inwardly tapered.

9. The fringe maker of claim 6, wherein the pivot pins are each spring-biased from a retracted position disposed within a pivot bore to an extended position also disposed within an adjacent coaxial pivot bore to facilitate initial assembly.

10. The fringe maker of claim 1, further comprising:

a retaining device; and wherein the crank support member has a crank-receiving slot that closely rotatably receives the hand crank and a retaining device receiving hole that intersects said slot to receive said retaining device and retain said hand crank thereto.

11. The fringe maker of claim 10, wherein the retaining device is chosen from the group consisting of a spring plunger and a retaining pin received within the retaining device receiving hole of the crank support member.

12. The fringe maker of claim 1, wherein the central area of the idler winding arm is rotatably connectable to the idler support member using a rotation pin that extends into respective pivot bores thereof.

13. The fringe maker of claim 1, wherein the hand crank includes a drive rod having a crank leg coaxially affixed to the central area of the crank winding arm and to a parallel, oppositely disposed handle leg through a connecting leg, and a gripping handle connected to said handle leg.

14. The fringe maker of claim 13, wherein the crank leg has a distal end with a drive spline coaxially affixed within a pivot bore in the central area of the crank winding arm.

15. The fringe maker of claim 1, wherein the winding arms each have two pluralities of rod-receiving bores that closely receive opposite ends of the winding rods in a plurality of the spaced relationships.

16. The fringe maker of claim 15, wherein the winding arms each comprise a support section of truncated triangular shape that includes the central areas and a dependent rod section of rectangular shape having the rod-receiving bores.

17. The fringe maker of claim 1, wherein each winding rod is of a cross-section chosen from the group consisting of circular, rectangular, polygonal, and oblong.

18. The fringe maker of claim 1, further comprising a middle winding arm that connects to and reinforces the winding rods intermediate the winding arms.

19. The fringe maker of claim 18, wherein the middle winding arm has a pair of end slots and two pluralities of side slots that closely receive the winding rods in a plurality of the spaced relationships.

20. The fringe maker of claim 19, wherein the end slots are at such a spacing and the side slots are angled inwardly so as to snap-fit to the winding rods.

21. The fringe maker of claim 1, further comprising:

a bendable ruler; and wherein the base has a ruler recess that closely receives said ruler when in a straight configuration.

22. The fringe maker of claim 1, wherein the base, the support members, the winding arms, the winding rods, and the hand crank are made of materials chosen from the group consisting of wooden boards, plywood, wood and plastic veneer, particle board, molded plastic, sheet plastic, stainless steel rod, and plated carbon steel rod.

23. A fringe maker for winding yarns to make a fringe, comprising:

an elongated base having a pair of spaced crank and idler support member recesses interconnected by a longitudinal winding rod recess, and a ruler recess, said base being of a construction chosen from the group consisting of a single piece and respective upper and lower bases that are affixed together;

a bendable ruler that when in a straight configuration closely fits within said ruler recess for storage;

a pair of crank and idler support members each comprising an upper section of generally rectangular shape and a thicker lower section that is longitudinally tapered with a rounded bottom pivotally connected to said base within respective of said crank and idler support member recesses using a plurality of pivot pins, said crank support member having a crank-receiving slot and a retaining device receiving hole that intersects said slot, said idler support member having a pivot bore, with each support member having an upright operating position stopped against said base and a horizontal storage position disposed within said support member recesses that each define a storage area thereunder;

a pair of elongated winding rods each of a cross-section chosen from the group consisting of circular, rectangular, polygonal, and oblong;

a pair of crank and idler winding arms each comprising a support section of truncated triangular shape having a central area with a pivot bore rotatably connectable respectively to said crank and idler support members while in said operating positions to rotate about a horizontal axis and a dependent rod section of rectangular shape having two pluralities of rod-receiving bores that closely receive opposite ends of said winding rods disposed in a plurality of spaced relationships equidistant from and at opposite sides of said axis to interconnect said winding arms to form a removable winding unit, said central area of said idler winding arm being rotatably connectable to said idler support member using a rotation pin that extends into said pivot bores thereof;

a retaining device;

a hand crank that includes a drive rod having a crank leg with splined distal end coaxially affixed within said pivot bore for hand-driving said crank winding arm and a parallel, oppositely disposed handle leg interconnected through a connecting leg, and a gripping handle connected to said handle leg, said crank leg being closely rotatably receivable within said crank-receiving slot of said crank support member retained thereto by said retaining device received in said retaining device receiving hole;

a middle winding arm having a pair of end slots, two pluralities of side slots that closely receive said winding rods in said spaced relationships, and a clearance bore centrally disposed thereon to receive said rotation pin of said idler winding arm during storage, said end slots being at such a spacing and said side slots being angled inwardly so as to snap-fit to and reinforce said winding rods intermediate said winding arms;

wherein the fringe is made by rotating said hand crank to wind the yarns around said winding rods, removing said winding unit with wound yarns from said base with support members for sewing a retaining seam to complete the fringe, and removing the fringe by disassembling said winding rods from said winding arms, said winding arms, said winding rods, and said hand crank being storable within said storage areas.

24. The fringe maker of claim 23, wherein the base has at least one feature chosen from the group consisting of a gripping slot, a gripping recess, a hanging hole, and a handle recess connected to one of the support member recesses, the upper base comprises a pair of edge-joined halves having a plurality of slots which the lower base covers to form said recesses, the pivot pins are each spring-biased from a retracted position disposed within one pivot bore to an extended position also disposed within an adjacent pivot bore to facilitate initial assembly, the retaining device is chosen from the group consisting of a spring plunger and a retaining pin received within the retaining device receiving hole of the crank support member, and said base, the support members, the winding arms, the winding rods, and the hand crank are made of materials chosen from the group consisting of wooden boards, plywood, wood and plastic veneer, particle board, molded plastic, sheet plastic, stainless steel rod, and plated carbon steel rod.

* * * * *